US005875985A

United States Patent [19]

Cohen et al.

[11] Patent Number: 5,875,985

[45] Date of Patent: Mar. 2, 1999

[54] INDENTED CORELESS ROLLS AND METHOD OF MAKING THE SAME

[75] Inventors: George R. Cohen; Donnie Lee Gantt, both of Marietta; Cleary Efton Mahaffey, Suwanee; John Richard Skerrett; Joseph Mitchell, both of Alpharetta, all of Ga.

[73] Assignee: Kimberly-Clark Worldwide, Inc., Neenah, Wis.

[21] Appl. No.: 925,241

[22] Filed: Sep. 8, 1997

Related U.S. Application Data

[63] Continuation-in-part of Ser. No. 843,670, Apr. 10, 1997, which is a continuation of Ser. No. 402,341, Mar. 10, 1995, Pat. No. 5,620,148.

[51] Int. Cl.[6] ..... B65H 18/28

[52] U.S. Cl. ..... 242/160.4; 264/324

[58] Field of Search ..... 242/160.1, 160.4, 242/541.2, 546, 599.4; 162/118, 120, 122; 264/322, 324, 512

[56] References Cited

U.S. PATENT DOCUMENTS

| | | | |
|---|---|---|---|
| Re. 25,828 | 8/1965 | Wooster | 242/596.7 |
| D. 238,462 | 1/1976 | Bauman | D6/523 |
| D. 238,466 | 1/1976 | Bauman | D6/523 |
| D. 316,201 | 4/1991 | Shimasaki | D6/518 |
| D. 318,770 | 8/1991 | Grisel | D6/523 |
| D. 327,798 | 7/1992 | Addison et al. | D6/523 |
| 390,084 | 9/1888 | Lane | 242/596.3 |
| 498,900 | 6/1893 | Hicks | 242/565 |
| 2,232,968 | 2/1941 | Price et al. | 242/595.1 |
| 2,276,414 | 3/1942 | Morehouse et al. | 225/42 |
| 2,299,626 | 10/1942 | Hunt | 242/598.6 |
| 2,308,840 | 1/1943 | Vaughan et al. | 242/564.4 |
| 2,380,644 | 7/1945 | Grondona | 242/596.7 |

(List continued on next page.)

FOREIGN PATENT DOCUMENTS

| | | |
|---|---|---|
| 833971 | 2/1970 | Canada . |
| 928671 | 6/1973 | Canada . |
| 2190806 | 6/1997 | Canada . |
| 0 089 933 | 9/1983 | European Pat. Off. . |
| 0 589 481 | 3/1994 | European Pat. Off. . |
| 0 608 046 | 7/1994 | European Pat. Off. . |
| 0618159A2 | 10/1994 | European Pat. Off. . |

(List continued on next page.)

OTHER PUBLICATIONS

JP 8196469 A (Abstract Only); Assignee: Sekisui Chem Ind Co. Ltd.; Mar. 4, 1991.

JP 8333041 A (Abstract Only); Assignee: Taisei Tekkosho KK; Dec. 17, 1996.

JP 8333055 A (Abstract Only); Assignee: Uchinami KK; Dec. 17, 1906.

JP 9118455 A (Abstract Only); Assignee: Taisei Tekkosho KK; May 6, 1997.

JP 9216755 A (Abstrsct Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec. 11, 1996.

*Primary Examiner*—John P. Darling
*Attorney, Agent, or Firm*—Karl V. Sidor

[57] ABSTRACT

A coreless roll of product that is self-supporting in a rotary dispenser. The roll includes a rolled web of product that is wound throughout its diameter about a winding axis into a cylinder having first and second flat ends. At least one flat end defines a mounting hole at substantially the center of the winding axis of the coreless roll. The mounting hole has a depth and has sides generally perpendicular to the end of the roll. The sides are separated by a distance that is less than the depth of the hole such that the mounting hole is adapted to receive a plunger from a rotary dispenser. Methods of making the coreless roll are also described.

32 Claims, 7 Drawing Sheets

U.S. PATENT DOCUMENTS

| | | | |
|---|---|---|---|
| 2,390,399 | 12/1945 | Tator et al. | 225/42 |
| 2,695,208 | 11/1954 | Graham | 225/33 |
| 2,726,823 | 12/1955 | Jespersen . | |
| 2,830,775 | 4/1958 | Kiesel | 242/523.1 |
| 2,839,346 | 6/1958 | Lawalin | 242/560.3 |
| 2,845,231 | 7/1958 | Grettve | 242/527 |
| 2,849,191 | 8/1958 | Gadler | 242/531.1 |
| 2,872,263 | 2/1959 | Andersson | 312/34.8 |
| 2,873,158 | 2/1959 | Pinkham, Jr. | 312/34.24 |
| 2,905,404 | 9/1959 | Simmons | 242/423.2 |
| 2,939,645 | 6/1960 | Rowlands et al. | 242/541.2 |
| 2,946,636 | 7/1960 | Penney | 312/34.22 |
| 3,004,693 | 10/1961 | Johnson | 225/77 |
| 3,029,035 | 4/1962 | Layton | 242/160.1 |
| 3,032,283 | 5/1962 | Wooster | 242/596.7 |
| 3,038,598 | 6/1962 | Layton et al. | 242/160.1 |
| 3,045,939 | 7/1962 | Vander Waal | 242/527.3 |
| 3,084,006 | 4/1963 | Roemer | 312/34.22 |
| 3,333,909 | 8/1967 | Beker | 312/34.22 |
| 3,580,651 | 5/1971 | Gauper | 242/560 |
| 3,791,601 | 2/1974 | Broden | 242/419 |
| 3,799,467 | 3/1974 | Bauman | 242/560 |
| 3,802,639 | 4/1974 | Dowd, Jr. . | |
| 3,823,887 | 7/1974 | Gerstein . | |
| 3,826,361 | 7/1974 | Heckrodt | 206/409 |
| 3,830,143 | 8/1974 | Dowd, Jr. | 23/84 FF |
| 3,853,279 | 12/1974 | Gerstein . | |
| 3,856,226 | 12/1974 | Dowd, Jr. . | |
| 4,191,307 | 3/1980 | LeCaire, Jr. et al. | 221/45 |
| 4,274,573 | 6/1981 | Finkelstein | 225/106 |
| 4,289,262 | 9/1981 | Finkelstein | 225/106 |
| 4,297,403 | 10/1981 | Smith | 428/42 |
| 4,314,679 | 2/1982 | Paul et al. | 242/560.3 |
| 4,410,221 | 10/1983 | Vallis et al. | 242/560.3 |
| 4,467,974 | 8/1984 | Crim | 242/419.4 |
| 4,487,378 | 12/1984 | Kobayashi . | |
| 4,583,642 | 4/1986 | Blythe et al. | 206/390 |
| 4,667,890 | 5/1987 | Gietman, Jr. . | |
| 4,695,005 | 9/1987 | Gietman, Jr. . | |
| 4,757,952 | 7/1988 | Balzer . | |
| 4,760,970 | 8/1988 | Larsson et al. | 242/422.5 |
| 4,767,075 | 8/1988 | Peters et al. . | |
| 4,783,015 | 11/1988 | Shimizu . | |
| 4,807,825 | 2/1989 | Elsner et al. . | |
| 4,832,271 | 5/1989 | Geleziunas | 242/422.5 |
| 4,860,893 | 8/1989 | Kaufman | 200/390 |
| 5,097,998 | 3/1992 | Shimasaki | 225/106 |
| 5,100,075 | 3/1992 | Morand . | |
| 5,161,793 | 11/1992 | Lotto et al. | 271/182 |
| 5,170,958 | 12/1992 | Brown | 242/598.6 |
| 5,197,727 | 3/1993 | Lotto et al. | 271/183 |
| 5,205,455 | 4/1993 | Moody | 225/106 |
| 5,215,211 | 6/1993 | Eberle | 221/1 |
| 5,219,126 | 6/1993 | Schutz . | |
| 5,271,137 | 12/1993 | Schutz | 29/400.1 |
| 5,271,575 | 12/1993 | Weinert . | |
| 5,281,386 | 1/1994 | Weinert | 264/512 |
| 5,310,129 | 5/1994 | Whittington et al. . | |
| 5,352,319 | 10/1994 | Ishizu et al. | 156/446 |
| 5,362,013 | 11/1994 | Gietman, Jr. et al. | 242/521 |
| 5,366,175 | 11/1994 | Schutz | 242/597.6 |
| 5,370,336 | 12/1994 | Whittington | 242/560 |
| 5,370,339 | 12/1994 | Moody et al. | 242/597.6 |
| 5,385,318 | 1/1995 | Rizzuto | 242/597.8 |
| 5,386,950 | 2/1995 | Abt | 242/532 |
| 5,387,284 | 2/1995 | Moody | 118/220 |
| 5,390,875 | 2/1995 | Gietman, Jr. et al. | 242/521 |
| 5,402,960 | 4/1995 | Oliver et al. | 242/527.1 |
| 5,407,509 | 4/1995 | Ishizu et al. | 156/184 |
| 5,421,536 | 6/1995 | Hertel et al. | 242/526.1 |
| 5,439,187 | 8/1995 | Shimizu | 242/541.7 |
| 5,451,013 | 9/1995 | Schutz | 242/597.4 |
| 5,453,070 | 9/1995 | Moody | 493/288 |
| 5,467,935 | 11/1995 | Moody | 242/422.4 |
| 5,467,936 | 11/1995 | Moody | 242/525.7 |
| 5,474,436 | 12/1995 | Yamazaki | 425/103 |
| 5,480,060 | 1/1996 | Blythe | 221/63 |
| 5,495,997 | 3/1996 | Moody | 242/561 |
| 5,497,959 | 3/1996 | Johnson et al. | 242/542.2 |
| 5,505,402 | 4/1996 | Vigneau | 242/527.1 |
| 5,513,478 | 5/1996 | Abt | 53/118 |
| 5,518,200 | 5/1996 | Kaji et al. | 252/538.1 |
| 5,538,199 | 7/1996 | Biagiotti | 242/541.2 |
| 5,542,622 | 8/1996 | Biagiotti | 242/521 |
| 5,577,686 | 11/1996 | Moody | 242/597.4 |
| 5,603,467 | 2/1997 | Perini et al. | 242/521 |
| 5,609,269 | 3/1997 | Behnke et al. | 221/48 |
| 5,611,455 | 3/1997 | McCreary | 221/45 |
| 5,620,148 | 4/1997 | Mitchell | 242/160.4 |
| 5,620,544 | 4/1997 | Cram et al. | 156/184 |
| 5,636,812 | 6/1997 | Conner et al. | 242/559.2 |
| 5,639,046 | 6/1997 | Biagiotti | 242/541.2 |
| 5,669,576 | 9/1997 | Moody | 242/560.3 |
| 5,697,576 | 12/1997 | Bloch et al. | 242/596.8 |
| 5,722,608 | 3/1998 | Yamazaki | 242/160.1 |

FOREIGN PATENT DOCUMENTS

| | | | |
|---|---|---|---|
| 0698367A1 | 2/1996 | European Pat. Off. . | |
| 0729724A1 | 9/1996 | European Pat. Off. . | |
| 1 248 002 | 9/1971 | United Kingdom . | |
| 2 120 206 | 11/1983 | United Kingdom . | |
| 2 244 472A | 12/1992 | United Kingdom . | |
| 2 276 107 | 9/1994 | United Kingdom | 242/160.1 |
| 94/29205 | 12/1994 | WIPO . | |
| WO 94/27483 | 12/1994 | WIPO . | |
| 95/01929 | 1/1995 | WIPO . | |
| WO 95/08940 | 4/1995 | WIPO . | |
| 95/13183 | 5/1995 | WIPO . | |
| WO 96/26878 | 9/1996 | WIPO . | |
| WO 96/27546 | 9/1996 | WIPO . | |

INDENTED CORELESS ROLLS AND METHOD OF MAKING THE SAME

This application is a continuation in part of Ser. No. 08/843,670, filed Apr. 10, 1997 which is a continuation of Ser. No. 08/402,341, filed Mar. 10, 1995 now U.S. Pat. No. 5,620,148.

FIELD OF THE INVENTION

This invention pertains to the field of commercial and consumer roll format products such as, for example, absorbent paper products and which includes toilet tissue and paper towels. More specifically, this invention relates to an improved coreless roll of absorbent paper product that is formed so as to be easy to mount onto a dispenser.

BACKGROUND OF THE INVENTION

Commercial and consumer absorbent paper products such as toilet tissue and paper towels are typically distributed and dispensed in roll form, and nearly always include a hollow cylindrical core that the product is wrapped about. The core is usually some type of cardboard, which is glued together and to the product so that the core stays intact and the product does not separate from the core. The product is then dispensed by mounting the roll on a spindle, such as can be found on the ubiquitous bathroom toilet roll dispenser, that passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of toilet tissue have appeared on the market, primarily in Europe, that are wound throughout the entire diameter of the roll. There are advantages and disadvantages associated with the coreless rolls. Coreless rolls are ecologically superior to cored rolls because no adhesives or throwaway materials are used to make the product. In addition, more product can be provided in the space that would otherwise have been occupied by the core. Cored rolls are more expensive to manufacture than coreless rolls because of the expense of making the cores and joining the cores to the product. In addition, coreless rolls have the advantage of being less subject-to pilferage in commercial locations because of their inherent incompatibility with conventional dispensers. On the other hand, there are dispensing problems with coreless rolls that so far been difficult to overcome.

Conventional dispensers for coreless rolls typically include an enclosed support surface that the roll is supported on as it turns, and an opening through which the product is passed. While functional, these dispensers have some undesirable characteristics, including an inability to control drag resistance to withdrawal of the product, the fact that the product actually touches the inside of the dispenser, which might be considered unsanitary by some consumers, and an inability to provide 180 degree product access to the consumer. Many of the above described problems would be overcome if a dispenser existed for mounting a coreless roll to rotate about its axis, as cored roll dispensers do. Unfortunately, such a dispenser has yet to be successfully developed.

One of the problems that stands in the way of the development of such a dispenser involves how the coreless roll is to be centered on the dispenser. If the roll is not centered, a rotating imbalance will be created as the roll turns. Also, the roll will be prevented from dispensing product until expiration in the event that its winding axis is not precisely centered on the dispenser. However, since the typical coreless roll has flat, unbroken side surfaces, it is difficult to locate the location of the winding axis.

It is clear that a need exists for an improved system, method and product for permitting the effective dispensing of coreless rolls of absorbent consumer and commercial paper products.

SUMMARY OF THE INVENTION

The present invention addresses the problems described above by providing a method of treating a coreless roll of product to create a mounting hole in at least one end so the roll is self-supporting when mounted in a rotary dispenser.

The method includes the steps of: (a) providing a roll of product that is wound throughout its diameter about a winding axis into a cylinder having first and second flat ends; (b) positioning a face of an indenting tool at substantially the center of the winding axis of the roll at least at one end; (c) pressing the face of the positioned indenting tool into the end of the roll to generate a force substantially along the winding axis sufficient to substantially permanently compress a portion of the coreless roll, leaving an uncompressed portion of the roll to define a mounting hole having a depth and having sides generally perpendicular to the end of the roll, the sides being separated by a distance that is less than the depth of the hole; and (d) removing the indenting tool from the mounting hole without substantially deforming the sides of the mounting hole.

Generally speaking, the pressing step should compress a portion of the roll at least 5 percent, based on the width of the roll. For example, the pressing step should compress a portion of the roll at least 10 percent, based on the width of the roll.

The method may be adapted to high-speed manufacturing processes. The roll of product may be moved along a conveyor or line. The coreless roll may be in substantially continuous motion during the positioning, pressing and removing steps. The positioning step may further include the step of securing the coreless roll utilizing a positioning means. For example, the coreless roll may be inserted in a template, a mold, clasp, grip or similar device.

The indenting tool may be part of a rotating element radially mounted so the indenting tool is positioned at substantially the center of the winding axis of a coreless roll and pressed into the roll as the element rotates. In such configuration, it is desirable for the face of the indenting tool to have a radius of curvature. The profile of the indenting tool behind the face may be configured to avoid contact with the sides of the mounting hole. For example, the face of the indenting tool may be larger in cross-section or width than the portion of the tool (e.g., the stem or shaft) behind the face.

In an aspect of the invention, the pressing step may create sufficient axial compression to generate corrugations generally about the winding axis of the roll over at least a portion of the substantially permanently compressed portion of the roll.

The ends of the roll may be treated sequentially or may be treated simultaneously. It is contemplated that only one end of the roll may be treated with the other end of the roll being treated with a different tool, left untreated or subjected to a completely different treatment.

According to the method of the present invention, the coreless roll may be a coreless roll of an absorbent paper product. For example, the coreless roll maybe a coreless of a sanitary tissue product. The coreless roll desirably has a sufficient firmness and/or density to hold the compressed portion of the web in its compressed condition relatively indefinitely or at least for a substantial period of time.

According to an aspect of the invention, the method may further include a step of wetting the tool prior to the completion of the pressing step. Alternatively and/or additionally, the method may also include the step of wetting a portion of the side of the roll that the tool will be applied to prior to the pressing step.

In an embodiment of the invention, the pressing step may be performed by rotating the tool about an axis of the tool as the tool is pressed into the side of the roll. For example, the tool may be rotated clockwise or counter-clockwise somewhat similar to a drill bit, bore, trepan or auger as it is pressed into the side of the roll. Desirably, the tool is not configured to remove material from the roll during the pressing step. However, it is contemplated that some embodiments of the invention may be practiced so as to remove material from the roll.

The method of the invention may be practiced so the uncompressed portion of the roll defines a mounting hole having a depth, sides generally perpendicular to the end of the roll, and a generally circular cross-section. The mounting hole may also have a polygonal cross-section. The cross-section may be, triangular, square, diamond, semi-circular, "X", "Y" or "T"-shaped or the like. It is desirable that the mounting hole have has a cross-section width of at least 1 centimeter. If the mounting hole has a circular cross-section, it is desirable that the diameter be at least 1 centimeter. In such embodiments, it is important that the sides are separated by a distance that is generally less than the depth of the hole. The present invention also encompasses a coreless roll of product that is manufactured according to the method set forth above.

The present invention encompasses a coreless roll of product that is self-supporting in a rotary dispenser. The roll includes a rolled web of product that is wound throughout its diameter about a winding axis into a cylinder having first and second flat ends. At least one flat end defines a mounting hole at substantially the center of the winding axis of the coreless roll. The mounting hole has a depth and has sides generally perpendicular to the end of the roll. The sides are separated by a distance that is less than the depth of the hole such that the mounting hole is adapted to receive a plunger from a rotary dispenser.

The depth of the mounting hole may be at least about 5 percent of the width of the coreless roll. For example, the depth of the mounting hole may be at least about 10 percent of the width of the coreless roll. Generally speaking, it is desirable for the depth of the mounting hole to run from about 1 to about 2 times the width of the hole.

Desirably, each flat end of the coreless roll defines a mounting hole at substantially the center of the winding axis of the roll and at least one, and desirably each, mounting hole has a depth and has sides generally perpendicular to the end of the roll, the sides being separated by a distance that is less than the depth of the hole.

The mounting hole may have a generally circular cross-section. Alternatively, the mounting hole may have a polygonal cross-section. The cross-section may be, triangular, square, diamond, semi-circular, "X", "Y" or "T"-shaped or the like. It is desirable that the mounting hole have has a cross-section width of at least 1 centimeter. If the mounting hole has a circular cross-section, it is desirable that the diameter be at least 1 centimeter. It is contemplated that different cross sections and/or different diameter and/or different depth mounting holes may be used.

In an embodiment of the invention, the coreless roll may include a substantially permanently compressed portion at substantially the center of the winding axis of the roll and an uncompressed portion at a flat end defining the mounting hole. A section or portion of the compressed part of the roll may further include corrugations generally about the winding axis of the roll. These corrugations are generally visible when the roll is substantially depleted and essentially the compressed portion remains. In one aspect of the invention, the substantially permanently compressed portion of the roll partially decompresses as the roll becomes substantially depleted. For example, the compressed part of the roll may spring back slightly or exhibit some resilience and still be substantially permanently compressed. The slight spring or resilience may be useful to provide a force against a plunger of a rotary dispenser to help keep the roll in place and to prevent overspin.

The coreless roll may be a roll of an absorbent paper product. For example, the absorbent paper product may be selected from paper towel, paper tissue, paper wipers and the like. The coreless roll may be a roll of a nonwoven fabric or a textile. For example, the nonwoven fabric may be a knit material, a woven material, a flocked material, a stitch-bonded material, a meltblown fiber web, a spunbond filament web, a bonded-carded web, an air-formed web, a coformed web and/or combinations of one or more of the same. The coreless roll may be a roll of a composite material. For example, the composite material may be a laminate material, a film-textile laminate, a film-nonwoven laminate, an elastomeric composite material or the like.

These and various other advantages and features of novelty which characterize the invention are pointed out with particularity in the claims annexed hereto and forming a part hereof. However, for a better understanding of the invention, its advantages, and the objects obtained by its use,-reference should be made to the drawings which form a further part hereof, and to the accompanying descriptive matter, in which there is illustrated and described a preferred embodiment of the invention.

DETAILED DESCRIPTION

Figure 1:
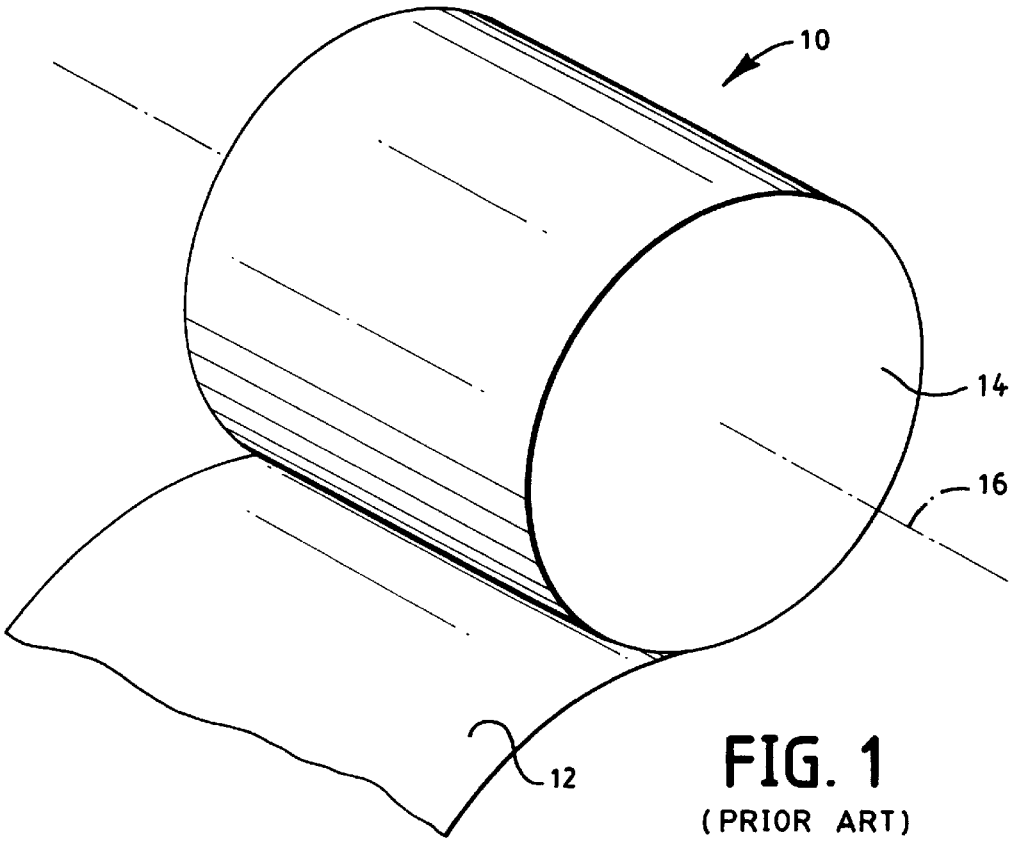
FIG. 1 (PRIOR ART)
FIG. 1 is a perspective view of a conventional coreless roll of product.

Referring now to the drawings, wherein like reference numeral designate corresponding structure throughout the views, FIG. 1 depicts a conventional coreless role 10 which may be a roll of an absorbent paper product web 12. The coreless role 10 is symmetrical about a winding axis 16 and has a pair of oppositely facing flat side surfaces 14 defined thereon which are substantially flat and unbroken. As may be imagined from viewing FIG. 1, it is difficult to locate the winding axis 16, which accounts for the difficulty of mounting such coreless rolls 10 onto rotary type dispensers such as, for example, the dispenser that is depicted in FIG. 3.

Figure 2A:
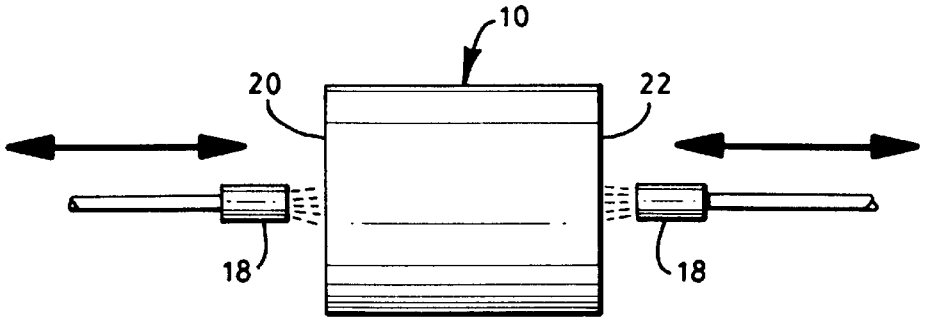
FIG. 2A is an illustration depicting a first step in an exemplary process of treating a coreless roll of product.
Figure 2B:
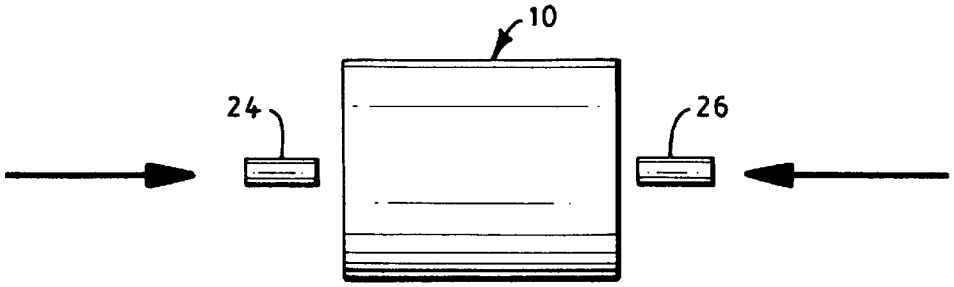
FIG. 2B is an illustration depicting another step in the process shown in FIG. 2A.
Figure 2C:
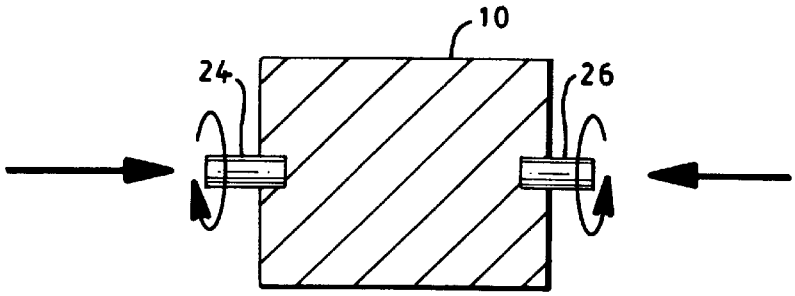
FIG. 2C is an illustration depicting another step in the process shown in FIGS. 2A and 2B.
Figure 2D:
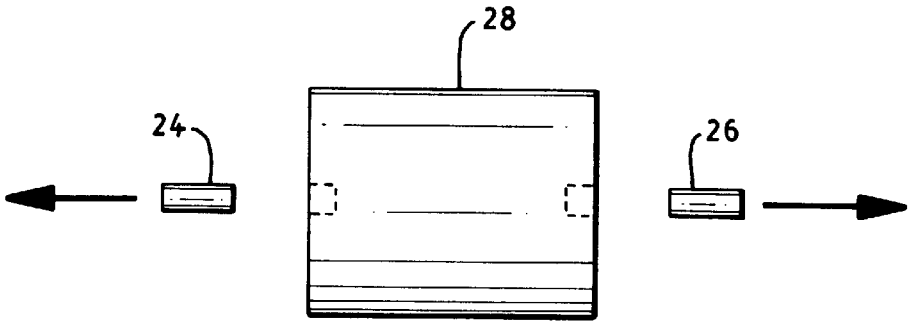
FIG. 2D is an illustration depicting another step in the process shown in FIGS. 2A–2C.
Figure 3:
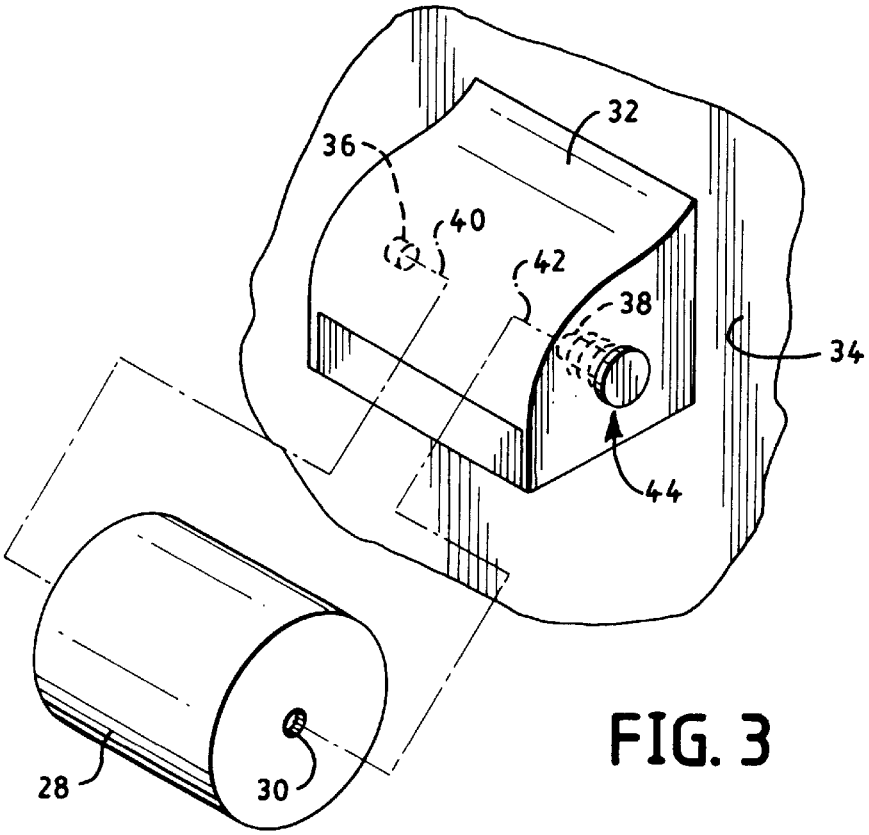
FIG. 3 is an illustration depicting installation of an exemplary improved coreless role on to a rotary dispenser.

FIGS. 2A–2D depict a method, according to an embodiment of the invention, of treating such a coreless roll 10 of a material which may be an absorbent paper product 12 so as to make it easier for a user to center a winding axis 16 of the coreless roll 10 with respect to a dispenser, such as the dispenser 32 that is depicted in FIG. 3. Referring to FIGS. 2A–2D, one method is performed by first dampening selected portions of the two oppositely facing side surfaces 20, 22 of the coreless roll 10. In one embodiment, this is carried out by advancing a pair of nozzles 18, respectively, toward the side surfaces 22 to dampen the central area of the side surfaces 20, 22.

The pair of nozzles 18 are then retracted, as is also indicated diagrammatically in FIG. 2A. Alternatively, the dampening depicted in FIG. 2A could be performed in other ways, such as by using the indenting tool itself to perform the dampening. The indenting tool could have a fluid passage defined therein, or a reservoir for holding the dampening fluid.

As is shown in FIG. 2B, a pair of cylindrical tools 24, 26 are then advanced toward the wetted center portion of the side surfaces 20, 22 of the coreless roll 10. These tools 24, 26 may have a diameter that is within the range of substantially 1/32 of an inch to about one inch. More desirably, these tools 24, 26 have diameters that are approximately one-half of an inch (about 1 centimeter). The tools 24, 26 may be turned about their respective axis as they are advanced into the wetted sides 20, and 22 of the coreless roll 10, as is shown in FIG. 2C. In some embodiments, it is generally thought that by wetting the area to be indented considerably less force is required to form the indentation. At the same time, the wetting may enable a more uniform and molded appearance to be achieved when forming the depression or mounting hole. In some embodiments, the indentation may be made by a combination of a rotary and plunging action. In some cases, a piston-like plunging action, without the rotary motion and/or without dampening, has been found to damage the edges of the hole or depression and lessens the likelihood of being able to obtain a uniform molded appearance.

After the step depicted in FIG. 2C, the tools 24, 26 are withdrawn, leaving the completed improved coreless roll 28 of product depicted in FIGS. 2D and 3. As is shown in FIG. 3, coreless roll 28 has a clearly defined depression 30 formed in the respective side surfaces 20, and 22 thereof.

The present invention also covers embodiments where the depth and the dimensions of the depression or mounting hole exceed the ranges that previously were considered. Such embodiments are useful to provide a coreless roll that is self-supporting when mounted in a rotary dispenser, can be made less subject to pilferage, and is more stable and provides more robust and reliable dispensing.

Figure 4:
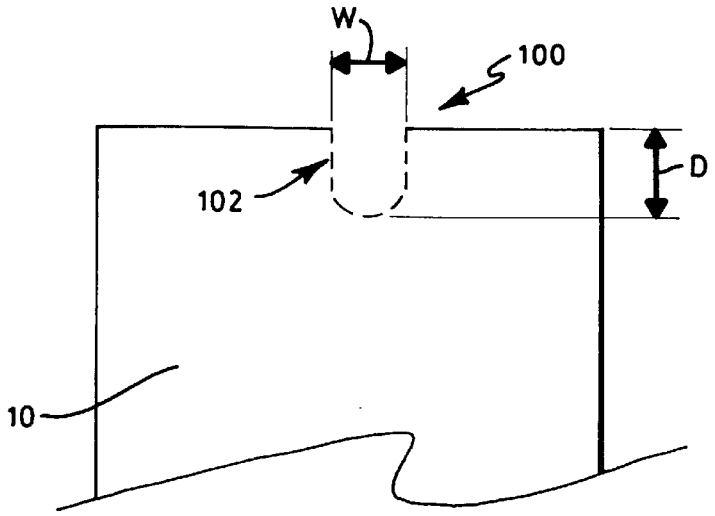
FIG. 4 is an illustration of a detail of an exemplary coreless roll of product.

This may be accomplished by a method of treating a coreless roll of product to create a mounting hole in at least one end so the roll is self-supporting when mounted in a rotary dispenser. Referring now to FIG. 4, there is shown a cross-section view of a coreless roll 10 with a mounting hole 100. The mounting hole 100 has a width "W" and a depth "D". According to the invention, the depth "D" of the mounting hole 100 should be at least as great as the width "W" of the mounting hole 100 and is desirably greater than the width of the mounting hole. As can be seen in FIG. 4, this relationship should establish a generally parallel, axially-oriented surface at the sides 102 of the mounting hole 100. In order to provide stable, robust and reliable dispensing as well as to make the coreless roll less susceptible to pilferage, it is desirable that the mounting holes have a circular cross section have a diameter ranging from about 0.25 inch to about 1.75 inch and a depth of at least about 1 times the width. Desirably, the depth may range from about 1 to about 2 times the width. It is contemplated that depths of greater than about 2 times the width may be used.

The method includes the steps of: (a) providing a roll of product that is wound throughout its diameter about a winding axis into a cylinder having first and second flat ends; (b) positioning a face of an indenting tool at substantially the center of the winding axis of the roll at least at one end; (c) pressing the face of the positioned indenting tool into the end of the roll to generate a force substantially along the winding axis sufficient to substantially permanently compress a portion of the coreless roll, leaving an uncompressed portion of the roll to define a mounting hole having a depth and having sides generally perpendicular to the end of the roll, the sides being separated by a distance that is less than the depth of the hole; and (d) removing the indenting tool from the mounting hole without substantially deforming the sides of the mounting hole.

Generally speaking, it is desirable that the roll of product, especially a roll of absorbent paper product, have a relatively high level of density. Desirably, the density or firmness of the roll will be greater than rolls of similar product wrapped around a conventional core. The density of the roll may be determined by conventional techniques. The firmness of the roll may be determined utilizing a Firmness Tester such as, for example, a Kershaw Roll Firmness Tester, Model 4Z289B(1) available from Kershaw Instrumentation, Inc., of Swedesboro, N.J. The tester may be equipped with a standard spindle RDSA-1.40.

Figure 5:
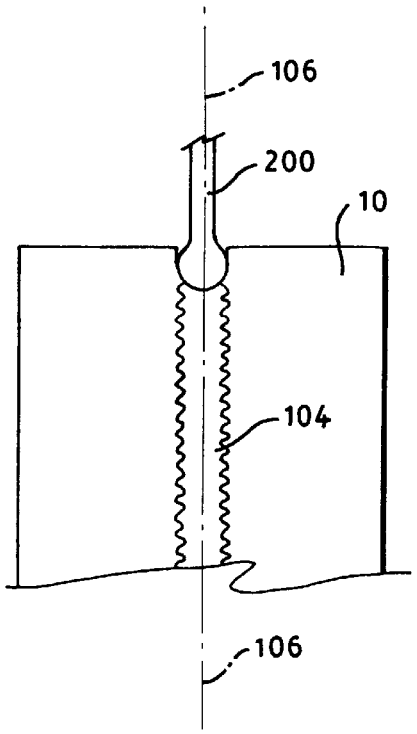
FIG. 5 is an illustration of an exemplary coreless roll depicting axial compaction.

According to an embodiment of the invention, it is important that the indenting tool is applied at substantially the center of the roll and compresses the center of the roll with a force that is substantially aligned along the winding axis of the roll. It is desirable that the force be sufficient to generate axial compaction of the center of the roll as shown in FIG. 5. In FIG. 5, a coreless roll 10 is shown with a tool 200 inserted in the roll. A central portion 104 at about the winding axis 106 is compressed axially. Generally speaking, satisfactory levels of axial compaction may be achieved with certain types of coreless rolls such as, for example, high density rolls of paper tissue, when the pressing step compresses the central portion of the roll at least 5 percent, based on the width of the roll. For example, desirable levels of axial compaction may be achieved when the pressing step compress a central portion of the roll at least 10 percent, based on the width of the roll.

Figure 6:
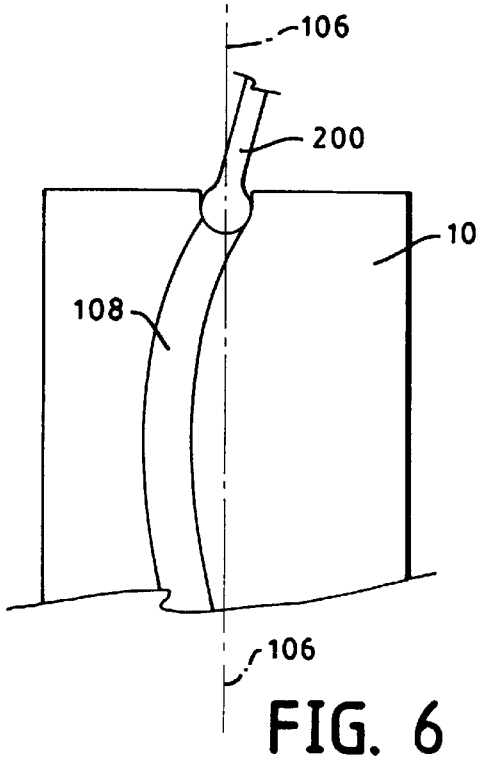
FIG. 6 is an illustration of an exemplary coreless roll depicting radial buckling.

If the compression forces are not almost completely axial, the central core will fail by bowing out to one side as shown in FIG. 6. In FIG. 6, a coreless roll 10 is shown with a tool 200 inserted in the roll. A central portion 108 at about the winding axis 106 is shown buckling out to one side. This failure may be described as radial buckling. Not only does such failure deforms the indentation shape, it may also create an off center indentation and may even deform the entire roll.

The method of the present invention may be adapted to high-speed manufacturing processes. The roll of product may be moved along a conveyor or line such that the coreless roll may be in substantially continuous motion during the positioning, pressing and removing steps.

Figure 7:
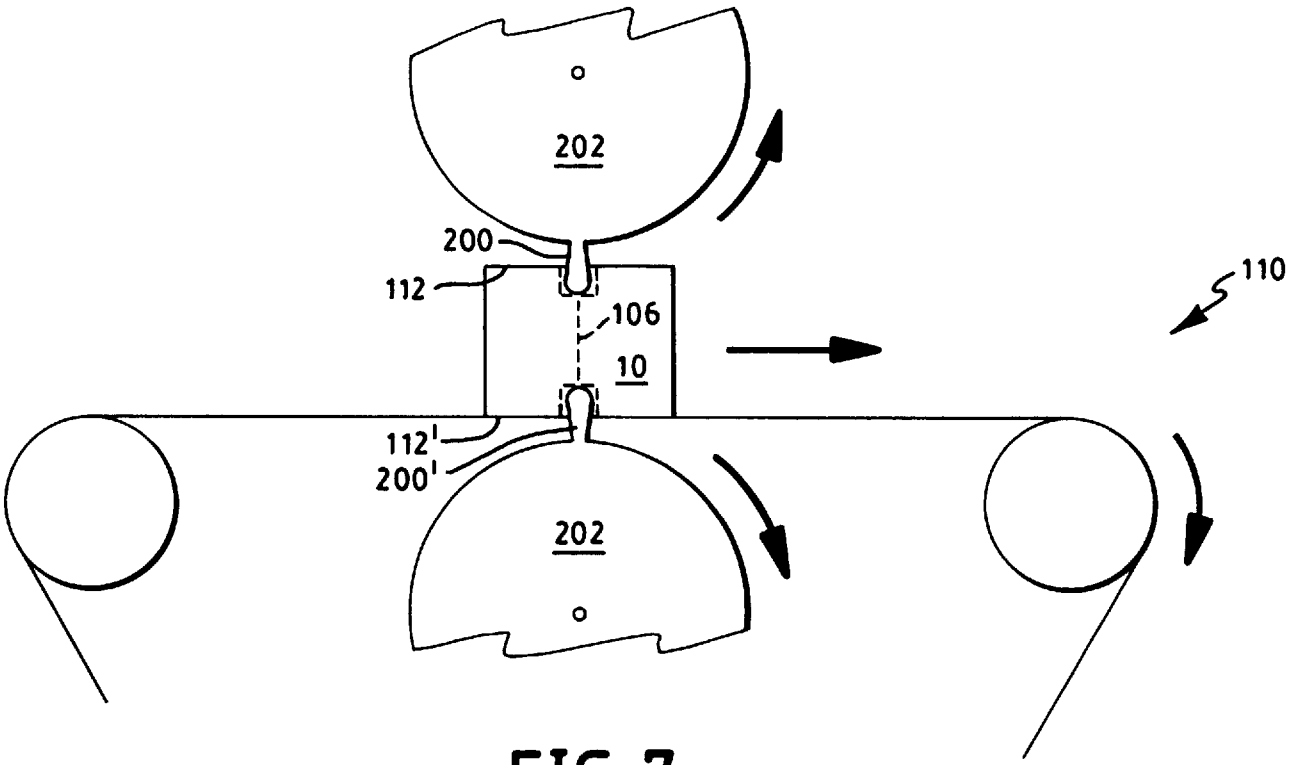
FIG. 7 is an illustration of a detail of an exemplary method of treating a coreless roll.

In some embodiments, the indenting tool may be part of a rotating element radially mounted above and/or below the roll as it passes a treatment station. Referring now to FIG. 7, there is shown a conveyor system 110 which carries the roll 10 in a direction as indicated by the arrows associated therewith.

A first tool 200 is part of a rotating element 202 and a second tool 200' is part of a second rotating element 202'. Each element and tool is positioned at substantially the center of the winding axis 106 of the coreless roll 10 and pressed into the flat surfaces 112 and 112' of roll as each respective element rotates in the direction of the arrows associated therewith. The rotation of the elements 202, 202' is adjusted so the tools 200, 200' track the center of the winding axis 106 of the coreless roll 10 as it is carried along by the conveyor system 110.

Figure 8:
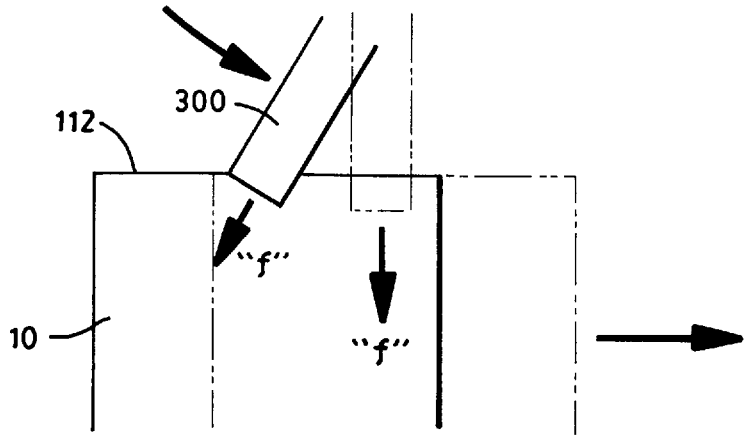
FIG. 8 is an illustration of a detail of an exemplary method of treating a coreless roll.

In such configuration, it is desirable for the face of the indenting tool to have a radius of curvature. If the face of the tool 200 was flat or conical, the tool would have a contact point the was not parallel to the flat surface 112 and 112' of the roll. This is illustrated in FIG. 8 which shows a flat-faced tool 300 as it rotates (in the direction of the arrow associated therewith) into the flat surface 112 of a coreless roll. The arrow labeled "f" extending from the flat face is intended to generally represent the direction of the force applied by the face of the tool. Note that the force is not perpendicular to the face of the roll at all times. This condition is thought to result in the failure described as radial buckling.

Figure 9:
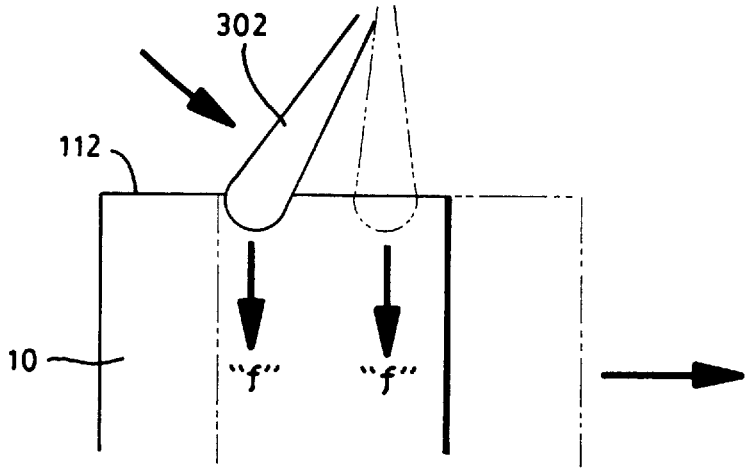
FIG. 9 is an illustration of a detail of an exemplary method of treating a coreless roll.

One desirable embodiment of the present invention may be seen in FIG. 9, which shows a radially faced tool 302 as it rotates into the flat surface 112 of a coreless roll. The arrow labeled "f" extending from the flat face is intended to generally represent the direction of the force applied by the face of the tool. Note that the force is depicted as generally perpendicular to the face of the roll at all times. This is condition is generally thought to product the desired axial compaction of the center of the roll and avoid the failure described as radial buckling.

Figure 10:
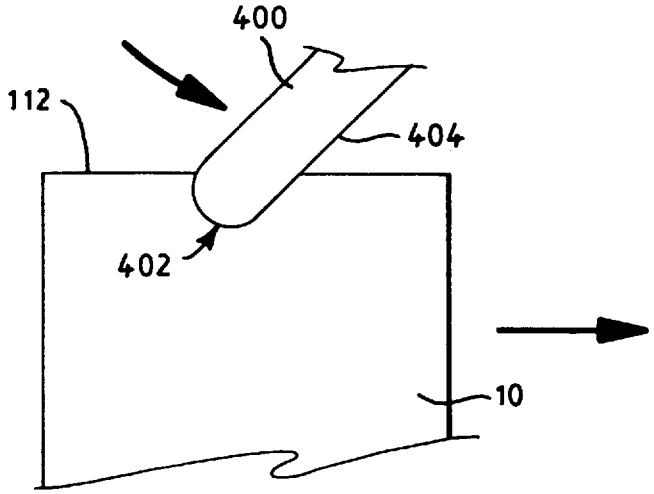
FIG. 10 is an illustration of a detail of an exemplary method of treating a coreless roll.
Figure 11:
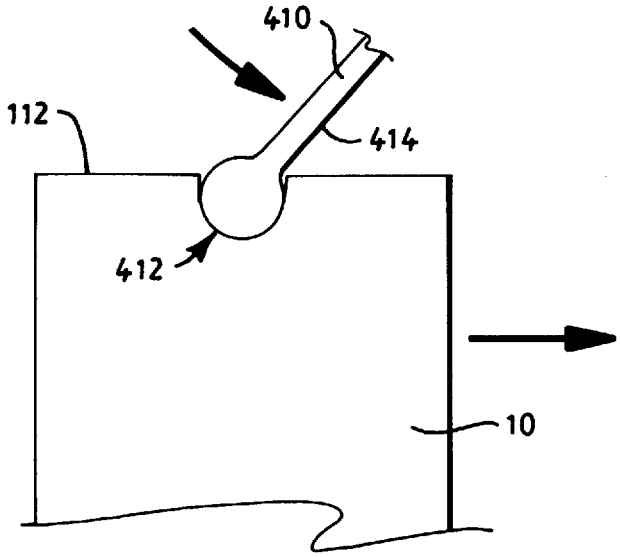
FIG. 11 is an illustration of a detail of an exemplary method of treating a coreless roll.

In an embodiment of the present invention, the profile of the indenting tool behind the contact head or face may be configured to avoid contact with the sides of the mounting hole. For example, the face of the indenting tool may be larger in cross-section or width than the portion of the tool (e.g., the stem or shaft) behind the face. This is generally illustrated in FIGS. 10 and 11. FIG. 10 shows a tool 400 with a radial face 402 and a straight stem or shaft 404 as the tool contacts the flat surface 112 of the roll 10 while the tool 400 rotates in the direction of the arrow associated therewith. As can be seen in FIG. 10, an edge of the shaft 404 well above the face 402 contacts the roll. This is more likely to be encountered when the depth of the hole is equal to or greater than the width as is specified in the present invention. Contact of the edge of the shaft 404 with the flat surface of the roll typically deforms the side of the mounting hole so the roll may be difficult to mount in a rotary dispenser and/or may produce buckling or deformation of the roll.

FIG. 11 is an illustration of an exemplary tool configuration which avoids this problem. A tool 410 with a radial face 412 and a narrow stem or shaft 414 contacts the flat surface 112 of the roll 10 while the tool 410 rotates in the direction of the arrow associated therewith. As can be seen in FIG. 11, the edge of the shaft 414 well above the face 412 avoids contact with the roll. This configuration permits satisfactory formation of a mounting hole wherein the depth of the hole is equal to or greater than the width as is specified in the present invention.

Figure 12A:
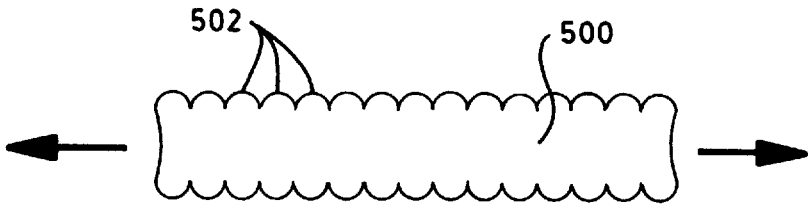
FIG. 12A is an illustration of a portion of an exemplary coreless roll depicting axial compaction.
Figure 12B:
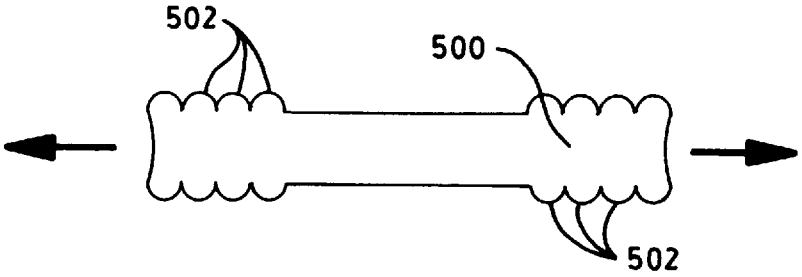
FIG. 12B is an illustration of a portion of an exemplary coreless roll depicting axial compaction.

In an aspect of the invention, the pressing step may create sufficient axial compression to generate corrugations generally about the winding axis of the roll over at least a portion of the substantially permanently compressed portion of the roll. This is illustrated in FIG. 12A which shows a core 500 of a substantially depleted roll exhibiting the results of axial compaction in the form of corrugations 502 generally over the entire compressed portion of the roll. As the roll is depleted, the corrugations 502 have a tendency to recover or expand the core 500 a small amount in the direction shown by the arrows associated therewith. This phenomena helps keep the substantially depleted roll from popping out of a dispenser. If the dispenser is the type that has spring-loaded plungers, axial compaction helps to prevent the substantially depleted core from bowing or buckling so as to be unsuitable for further dispensing. FIG. 12B is an illustration which shows a core 500 of a substantially depleted roll exhibiting the results of axial compaction in the form of corrugations 502 generally over only small sections of the compressed portion of the roll. Generally speaking, the advantages of axial compaction may still be present even when corrugations are present only over small sections of the compressed portion of the roll.

Figure 13:
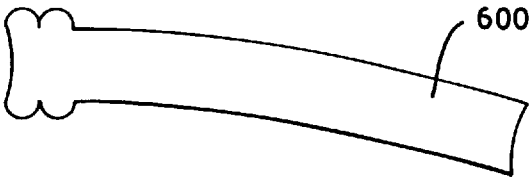
FIG. 13 is an illustration of a portion of a non-compacted coreless roll.

FIG. 13 is an illustration of a core 600 of a substantially depleted roll lacking any significant axial compaction which may appear in the form of corrugations on the compressed portion of the roll. As the roll is depleted, the non-compacted core 600 may bend or bow when subjected to pressure from spring-loaded plungers in a rotary dispenser.

The present invention encompasses a coreless roll of product that is self-supporting in a rotary dispenser. The roll includes a rolled web of product that is wound throughout its diameter about a winding axis into a cylinder having first and second flat ends. At least one flat end defines a mounting hole at substantially the center of the winding axis of the coreless roll. The mounting hole has a depth and has sides generally perpendicular to the end of the roll as shown in FIG. 4. The sides are separated by a distance that is less than the depth of the hole such that the mounting hole is adapted to receive a plunger from a rotary dispenser.

The depth of the mounting hole may be at least about 5 percent of the width of the coreless roll. For example, the depth of the mounting hold may be at least about 10 percent of the width of the coreless roll. Generally speaking, it is desirable for the depth of the mounting hole to run from about 1 to about 2 times the width of the hole. Desirably, each flat end of the coreless roll defines a mounting hole at substantially the center of the winding axis of the roll and at least one, and desirably each, mounting hole has a depth and has sides generally perpendicular to the end of the roll, the sides being separated by a distance that is less than the depth of the hole.

The mounting hole or holes may have a generally circular cross-section. The mounting hole may also have a polygonal cross-section. The cross-section may be, triangular, square, diamond, semi-circular, "X", "Y" or "T"-shaped or the like. It is desirable that the mounting hole have has a cross-section width of at least 1 centimeter. If the mounting hole has a circular cross-section, it is desirable that the diameter be at least 1 centimeter. It is contemplated that different cross sections and/or different diameter and/or different depth mounting holes may be used.

In an embodiment of the invention, the coreless roll may include a substantially permanently compressed portion at substantially the center of the winding axis of the roll and an uncompressed portion at a flat end defining the mounting hole. A section or portion of the compressed part of the roll may further include corrugations generally about the winding axis of the roll as shown in FIGS. 12A and 12B. These corrugations are generally visible when the roll is substantially depleted and essentially the compressed portion remains. In one aspect of the invention, the substantially permanently compressed portion of the roll partially decompresses as the roll becomes substantially depleted as described above. For example, the compressed part of the roll may spring back slightly or exhibit some resilience and still be substantially permanently compressed. The slight spring or resilience may be useful to provide a force against a plunger of a rotary dispenser such as, for example, of the type shown in FIG. 3 to help keep the roll in place and to prevent overspin.

Referring now to FIG. 3, the invention also includes a method of mounting the improved coreless roll 28 (which may be a roll of absorbent paper product) onto a dispenser, such as the dispenser 32 shown in FIG. 3 that is mounted to a wall 34. This is accomplished by locating the depressions 30 that are formed in the respective side surfaces of the improved coreless roll 28, then aligning the coreless roll 28 with respect to the dispenser 32. In practice, this is done by aligning the depressions 30 with dowels or plunger 36, 38 in the dispenser 32. The dowels or plungers 36, 38 may have pins 40, 42 extending from ends thereof to further aid in retention of the coreless roll 28 on the dispenser 32 during operation. A retracting mechanism 44 may be provided to retract the second dowel 38 for ease of installation and/or removal of a coreless roll 28 from the dispenser 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of treating a careless roll of product to create a mounting hole in at least one end of the roll to provide a self-supporting roll for mounting in a rotary dispenser, the method comprising steps of:

providing a roll of product that is wound throughout its diameter about a winding axis into a cylinder having first and second flat ends;

positioning a face of an indenting tool at substantially the center of the winding axis of the roll at least at one end;

pressing the face of the positioned indenting tool into the end of the roll to generate a force substantially along the winding axis sufficient to substantially permanently compress a portion of the careless roll, leaving an uncompressed portion of the roll to define a mounting hole having a depth and having sides generally perpendicular to the end of the roll, the sides being separated by a distance that is less than the depth of the hole; and removing the indenting tool from the mounting hole without substantially deforming the sides of the mounting hole.

2. The method of claim 1, wherein the pressing step compresses a portion of the roll at least 5 percent, based on the width of the roll.

3. The method of claim 1, wherein the pressing step compresses a portion of the roll at least 10 percent, based on the width of the roll.

4. The method of claim 1, wherein the careless roll is in substantially continuous motion during the positioning, pressing and removing steps.

5. The method of claim 1, wherein the indenting tool is part of a rotating element radially mounted so the indenting tool is positioned at substantially the center of the winding axis of a coreless roll and pressed into the roll as the element rotates.

6. The method of claim 1, wherein the face of the indenting tool has a radius of curvature.

7. The method of claim 1, wherein the profile of the indenting tool behind the face is configured to avoid contact with the sides of the mounting hole.

8. The method of claim 1, wherein the pressing step creates sufficient axial compression to generate corrugations generally about the winding axis of the roll over at least a portion of the substantially permanently compressed portion of the roll.

9. The method of claim 1, wherein the positioning step further comprises securing the coreless roll utilizing a positioning means.

10. The method of claim 1, wherein the ends of the roll are treated sequentially.

11. The method of claim 1, wherein the ends of the roll are treated simultaneously.

12. The method of claim 1, wherein the coreless roll is a coreless roll of an absorbent paper product.

13. The method of claim 12, wherein the coreless roll is a coreless of a sanitary tissue product.

14. The method of claim 1, further comprising a step of wetting the tool prior to the completion of the pressing step.

15. The method of claim 1, further comprising the step of wetting a portion of the side of the roll that the tool will be applied to prior to the pressing step.

16. The method of claim 1, wherein the pressing step is performed by rotating the tool about an axis of the tool as the tool is pressed into the side of the roll.

17. The method of claim 1, wherein the uncompressed portion of the roll defines a mounting hole having a depth, sides generally perpendicular to the end of the roll, and a generally circular cross-section, and wherein the sides are separated by a distance that is less than the depth of the hole.

18. The method of claim 1, wherein the uncompressed portion of the roll defines a mounting hole having a depth, sides generally perpendicular to the end of the roll, and a generally polygonal cross-section, and wherein the sides are separated by a distance that is less than the depth of the hole.

19. A coreless roll of product that is manufactured according to the method set forth in claim 1.

20. A coreless roll of product that is self-supporting in a rotary dispenser, the roll comprising:

a rolled web of product that is wound throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole is adapted to receive a plunger from a rotary dispenser.

21. The coreless roll of claim 20, wherein the depth of the mounting hole is at least about 5 percent of the width of the coreless roll.

22. The coreless roll of claim 20, wherein the depth of the mounting hole is at least about 10 percent of the width of the coreless roll.

23. The coreless roll of claim 20, wherein each flat end defines a mounting hole at substantially the center of the winding axis of the coreless roll, at least one mounting hole having a depth and having sides generally perpendicular to the end of the roll, the sides being separated by a distance that is less than the depth of the hole.

24. The coreless roll of claim 20, wherein at least one flat end defines a mounting hole having a depth, sides generally perpendicular to the end of the roll, and a generally circular cross-section, and wherein the sides are separated by a distance that is less than the depth of the hole.

25. The coreless roll of claim 20, wherein at least one flat end defines a mounting hole having a depth, sides generally perpendicular to the end of the roll, and a generally polygonal cross-section, and wherein the sides are separated by a distance that is less than the depth of the hole.

26. The coreless roll of claim 20, wherein the roll includes a substantially permanently compressed portion at substantially the center of the winding axis of the roll and an uncompressed portion at a flat end defining the mounting hole.

27. The coreless roll of claim 26, wherein at least a portion of the compressed portion of the roll includes corrugations generally about the winding axis of the roll.

28. The coreless roll of claim 26, wherein the substantially permanently compressed portion of the roll partially decompresses as the roll becomes substantially depleted.

29. The coreless roll of claim 20, wherein the product is an absorbent paper product.

30. The coreless roll of claim 29, wherein the absorbent paper product is selected from paper towel, paper tissue, paper wipers and the like.

31. The coreless roll of claim 30, wherein the product is a nonwoven fabric.

32. The coreless roll of claim 20, wherein the product is a composite material.

* * * * *